US011255238B2

(12) United States Patent
Rönnmark et al.

(10) Patent No.: US 11,255,238 B2
(45) Date of Patent: Feb. 22, 2022

(54) MUFFLER COMPRISING A HELMHOLTZ RESONATOR AND A VEHICLE COMPRISING SUCH A MUFFLER

(71) Applicant: Volvo Car Corporation, Gothenburg (SE)

(72) Inventors: Fredrik Rönnmark, Lindome (SE); Mathias Klein, Gothenburg (SE)

(73) Assignee: Volvo Car Corporation, Gothenburg (SE)

( * ) Notice: Subject to any disclaimer, the term of this patent is extended or adjusted under 35 U.S.C. 154(b) by 339 days.

(21) Appl. No.: 16/362,768

(22) Filed: Mar. 25, 2019

(65) Prior Publication Data

US 2019/0323396 A1 Oct. 24, 2019

(30) Foreign Application Priority Data

Apr. 20, 2018 (EP) ..... 18168497

(51) Int. Cl.
*F01N 1/02* (2006.01)
*F01N 13/08* (2010.01)
*F01N 1/16* (2006.01)

(52) U.S. Cl.
CPC ..... *F01N 1/023* (2013.01); *F01N 1/163* (2013.01); *F01N 1/166* (2013.01); *F01N 13/08* (2013.01);
(Continued)

(58) Field of Classification Search
CPC ..... F01N 1/023; F01N 1/163; F01N 1/166; F01N 13/08; F01N 2470/02; F01N 2470/14; F01N 2490/15
(Continued)

(56) References Cited

U.S. PATENT DOCUMENTS 7,004,283 B2 * 2/2006 Worner ..... F01N 1/02 181/239
9,638,077 B2 * 5/2017 Horr ..... F01N 1/163
2016/0084127 A1 3/2016 Arai

FOREIGN PATENT DOCUMENTS

CN 1858413 A 11/2006
CN 102086795 A 6/2011
(Continued)

OTHER PUBLICATIONS

English translation of JP 2009062972A, accessed Apr. 22, 2021 from Espacenet.*
(Continued)

*Primary Examiner* — Jeremy A Luks
(74) *Attorney, Agent, or Firm* — Clements Bernard Walker; Christopher L. Bernard

(57) ABSTRACT

A muffler for a vehicle, where the muffler comprises a partition wall that divides the interior in a first chamber and a second chamber, where an inlet pipe comprising a perforated section arranged in the first chamber and a closed section arranged in the first chamber, where the outlet opening of the inlet pipe is arranged in the second chamber, a first outlet pipe comprising an inlet opening arranged in the first chamber and an outlet opening arranged outside of the muffler, where the muffler comprises a second outlet pipe having an inlet opening arranged in the second chamber, and where the second outlet pipe is provided with an exhaust valve adapted to open or close the exhaust gas flow through the second outlet pipe. The advantage of the invention is that a muffler with an improved low frequency noise attenuation and low backpressure is provided.

20 Claims, 3 Drawing Sheets

(52) U.S. Cl.
CPC ..... *F01N 2470/02* (2013.01); *F01N 2470/14* (2013.01); *F01N 2490/15* (2013.01)

(58) Field of Classification Search
USPC ..... 181/239
See application file for complete search history.

(56) References Cited

FOREIGN PATENT DOCUMENTS

| | | | |
|---|---|---|---|
| DE | 19729666 | A1 | 1/1998 |
| EP | 1760279 | A2 | 3/2007 |
| JP | S6019907 | A | 2/1985 |
| JP | 0893440 | A | 4/1996 |
| WO | 2008150024 | A1 | 12/2008 |

OTHER PUBLICATIONS

English translation of JP 6019907, accessed Apr. 21, 2021 from Espacenet.*
Jun. 14, 2018 European Search Report issue on International Application No. EP18168497.
Office action and search report issued in the corresponding CN application No. 201910298685.5.

* cited by examiner

MUFFLER COMPRISING A HELMHOLTZ RESONATOR AND A VEHICLE COMPRISING SUCH A MUFFLER

CROSS-REFERENCE TO RELATED APPLICATION

The present patent application/patent claims the benefit of priority of co-pending European Patent Application No. 18168497.8, filed on Apr. 20, 2018, and entitled "MUFFLER COMPRISING A HELMHOLTZ RESONATOR AND A VEHICLE COMPRISING SUCH A MUFFLER," the contents of which are incorporated in full by reference herein for all purposes.

TECHNICAL FIELD

The present invention relates to a muffler for an exhaust gas system of a vehicle comprising an internal combustion engine, where the muffler is adapted to provide good noise attenuation both for lower frequencies at lower engine speeds and for higher frequencies at higher engine speeds. The present invention also relates to a vehicle comprising such a muffler.

BACKGROUND

Vehicles comprising an internal combustion engine generate noise during the combustion of the fuel-air mixture, during the compression of the fuel-air mixture and during the discharge of the combusted fuel-air mixture. In order to reduce some of the created noise, the exhaust gas system of the vehicle is provided with a muffler adapted to reduce the airborne noise. Some noise is also created from the design of the exhaust system with respect to wanted backpressure in the exhaust gas system.

Exhaust noise is often regarded as being disadvantageous, especially excessive exhaust noise. There are legislative requirements imposed by different markets that regulate the allowed maximum sound pressure from a vehicle. Further, most customer do not want a vehicle with a too high noise level or with unpleasant noise characteristics. Some manufacturers design the noise characteristics to fit the image of the vehicle, and may e.g. design the exhaust gas system to amplify and emit certain frequencies. Other manufacturers try to reduce all frequencies of the created noise in order to provide a silent vehicle. In this case, it is of advantage to design the exhaust gas system to interact with the insulation of the vehicle, i.e. to reduce the frequencies emitted from the exhaust gas system that are not filtered by the insulation. These are normally low frequencies.

The noise emitted by the exhaust gas system is reduced by an exhaust muffler located ahead of the exhaust gas system discharge port and downstream of a catalytic converter and/or other exhaust gas aftertreatment systems. A muffler may e.g. function with absorption and/or reflection principles. It is also common to use a resonance absorber that operates according to the Helmholtz resonator principle.

A Helmholtz resonator consists of a body enclosing an air volume, the body comprising a resonator neck or Helmholtz neck having an opening connecting the air volume with the surroundings. Due to the opening in the Helmholtz neck, the air volume is not surrounded by the body completely, but can be considered divided into first and second sub-volumes of air. The first sub-volume of air is defined by the geometry of the Helmholtz neck and extends from the opening in the Helmholtz neck along the entire length of the Helmholtz neck. The size of the first sub-volume of air thus depends on the cross section and the length of the Helmholtz neck. The Helmholtz neck may further be straight-lined or curved. The second sub-volume of air adjoins the first sub-volume of air inside the body directly, the Helmholtz neck thereby separating it from the body's opening. The second sub-volume of air being bigger than the first sub-volume of air is defined by the body's geometry exclusive of the Helmholtz neck. The elasticity of the air volume inside the body combines with the inertial mass of the air present in the Helmholtz neck to form a mechanical mass-spring system. Subject to the shape of the air volume, the mass-spring system has either one (for a spherical shape) resonance frequency (natural frequency) or a plurality (for shapes different to a sphere) of resonance frequencies (natural frequencies). The natural frequency depends inter alia on the size of the air volume enclosed, the cross-sectional area of the opening in the Helmholtz neck, the length of the Helmholtz neck, and a port adjustment factor depending on the ports shape and configuration (e.g. round, angular shaped, slit-like).

One problem with all mufflers is that a muffler is not adapted to attenuate all frequencies created during combustion of the internal combustion engine. This is valid for both the absorption and the reflection principle. A further problem is that the backpressure in the muffler increases with increased engine speed. Since the low frequencies constitute the most significant noise source, a muffler is often designed to attenuate low frequencies. Such a solution will however create a high backpressure at higher engine speeds, which reduces the efficiency of the combustion engine. Further, using exhaust pipes with a smaller diameter will also improve Noise, Vibration and Harshness (NVH) performance of the exhaust gas system, but will increase the backpressure of the exhaust gas system. One noise source is the noise that originates from engine pulsation, which is a low frequency noise, and exhaust gas flow noise due to high exhaust gas flow velocity, which is a higher frequency noise.

There are known exhaust gas systems that use a valve to switch between two different muffler configurations, adapted for different frequencies. One such muffler is known from EP 1760279 B1, in which the muffler comprises a housing having at least one exhaust inlet and at least one exhaust outlet and having at least two pipes at the inlet end or at the outlet end, where one pipe is switchable between an open state and a closed state and is acoustically coupled to a silencer system, such that the silencer system is active when the switchable pipe is opened as well as when it is closed and has a different damping characteristic when the switchable pipe is opened than when the switchable pipe is closed.

Such a muffler may function relatively well at certain conditions, but there is still room for improvements.

SUMMARY

An object of the invention is therefore to provide an improved muffler for an exhaust gas system of a vehicle. A further object of the invention is to provide a vehicle comprising such a muffler.

In a muffler for an exhaust gas system of a vehicle comprising an internal combustion engine, the muffler comprising a gas-tight housing, a partition wall dividing the interior of the housing in a first chamber and a second chamber, an inlet pipe extending through the first chamber and comprising a perforated section arranged in the first chamber and a closed section arranged in the first chamber, where the inlet opening of the inlet pipe is arranged outside of the housing and where the outlet opening of the inlet pipe is arranged in the second chamber, a first outlet pipe comprising an inlet opening arranged in the first chamber and an outlet opening arranged outside of the housing, the object of the invention is achieved in that the muffler comprises a second outlet pipe having an inlet opening arranged in the second chamber and an outlet opening arranged outside of the housing, and where the second outlet pipe is provided with a valve adapted to open or close the gas flow through the second outlet pipe.

By this first embodiment of a muffler according to the invention, a switchable exhaust muffler is provided, where the muffler can transform from a muffler using a Helmholtz resonator at lower engine speeds to a conventional muffler at higher engine speeds with low backpressure. By using a Helmholtz resonator technology at lower engine speeds, an improved noise attenuation at lower engine speeds is achieved, and by using a conventional muffler technology at higher engine speeds, an improved noise attenuation at higher engine speeds with lower backpressure is achieved. In this way, the disadvantage of using only a Helmholtz resonator for all engine speeds is removed.

The housing of the muffler is airtight in order to prevent exhaust gas to escape through the outer surfaces of the muffler. The partition wall may also be airtight or may be arranged with one or more smaller openings in the partition wall, in order to introduce a controlled leakage. The purpose of using a controlled leakage is to smooth the damping characteristics of the Helmholtz resonator. With an airtight partition wall, the damping will be relatively sharp at the tuned frequency with a high attenuation at the centre frequency, and with a relatively narrow bandwidth. This corresponds to a relatively high Q factor. With a controlled leakage, the damping characteristics will not be as high at the centre frequency, but with a wider bandwidth. Such a muffler will have a lower Q factor.

In modern vehicles, it is important to reduce the Noise, Vibration and Harshness (NVH) of the vehicle. The purpose of a muffler in an exhaust gas system of a combustion engine driven vehicle is on one hand to provide a good low frequency noise attenuation in order to provide a low noise level inside the vehicle and on the other hand to provide a low backpressure in the exhaust gas system in order to provide good engine performance, and at the same time to reduce noise with higher frequencies. These requirements contradict each other, which means that a conventional muffler is a compromise between low frequency noise attenuation and low backpressure.

In a conventional muffler, good low noise attenuation is achieved by using exhaust pipes having a relatively small diameter, but such exhaust pipes will give a relatively high backpressure at higher engine speeds. Some mufflers use a valve adapted to open an exhaust pipe at a specified engine speed in order to reduce the backpressure at higher engine speeds. Other mufflers use Helmholtz resonators to attenuate lower frequencies, but since a Helmholtz resonator is tuned to a specific frequency, the attenuation of higher frequencies is reduced.

In the inventive muffler, the muffler is switched from using a Helmholtz resonator to a conventional muffler by opening a valve which disengages the Helmholtz resonator and converts the muffler to a conventional muffler. In one example, the muffler comprises an additional exhaust pipe with a valve, which is adapted to lower the backpressure further at higher engine speeds.

BRIEF DESCRIPTION OF DRAWINGS

The invention will be described in greater detail in the following, with reference to the attached drawings, in which.

DESCRIPTION OF EMBODIMENTS

The embodiments of the invention with further developments described in the following are to be regarded only as examples and are in no way to limit the scope of the protection provided by the patent claims.

Figure 1:
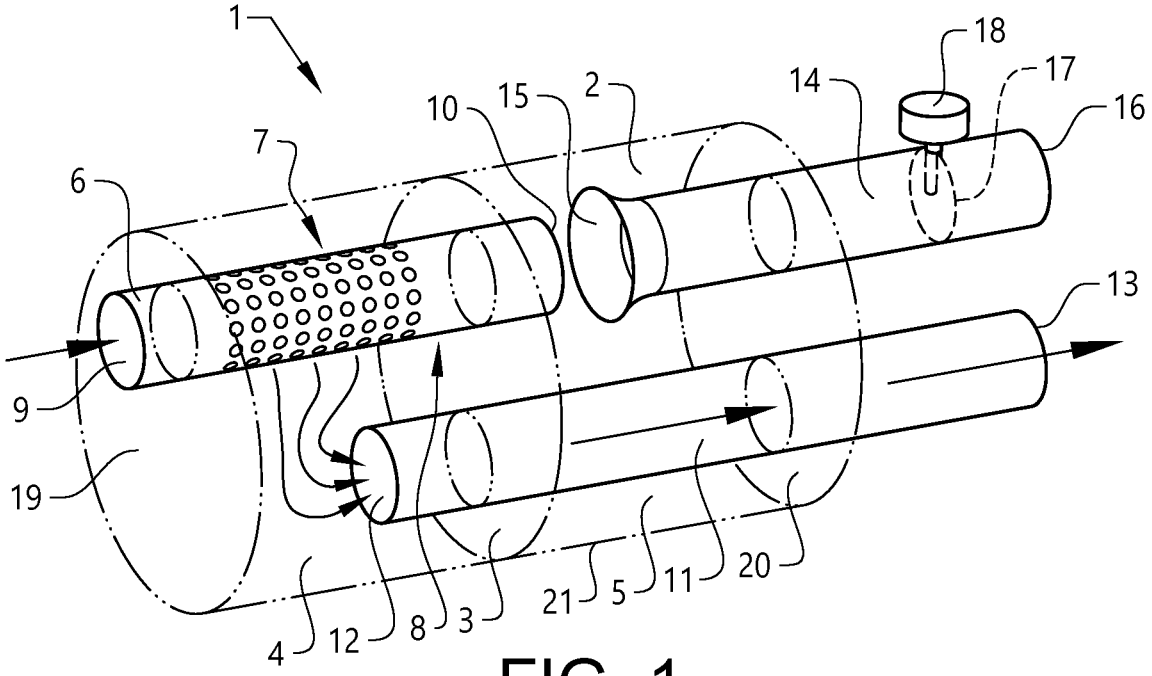
FIG. 1 shows a first example of a muffler according to the invention with the valve in a closed state.
Figure 2:
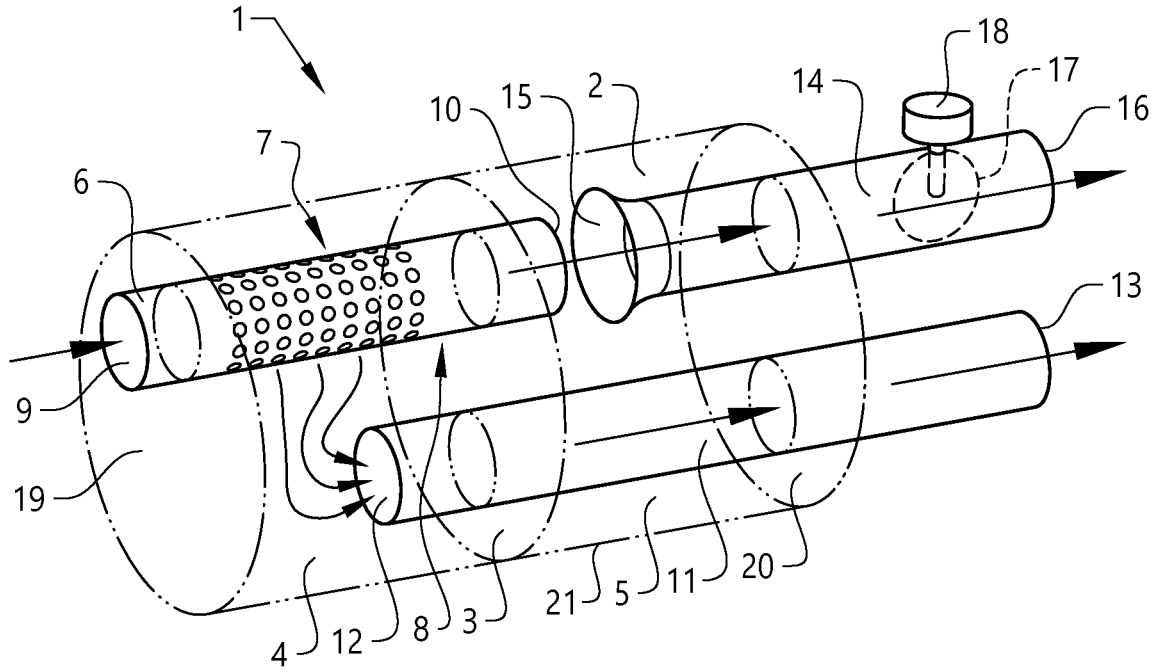
FIG. 2 shows a first example of a muffler according to the invention with the valve in an open state.
Figure 3:
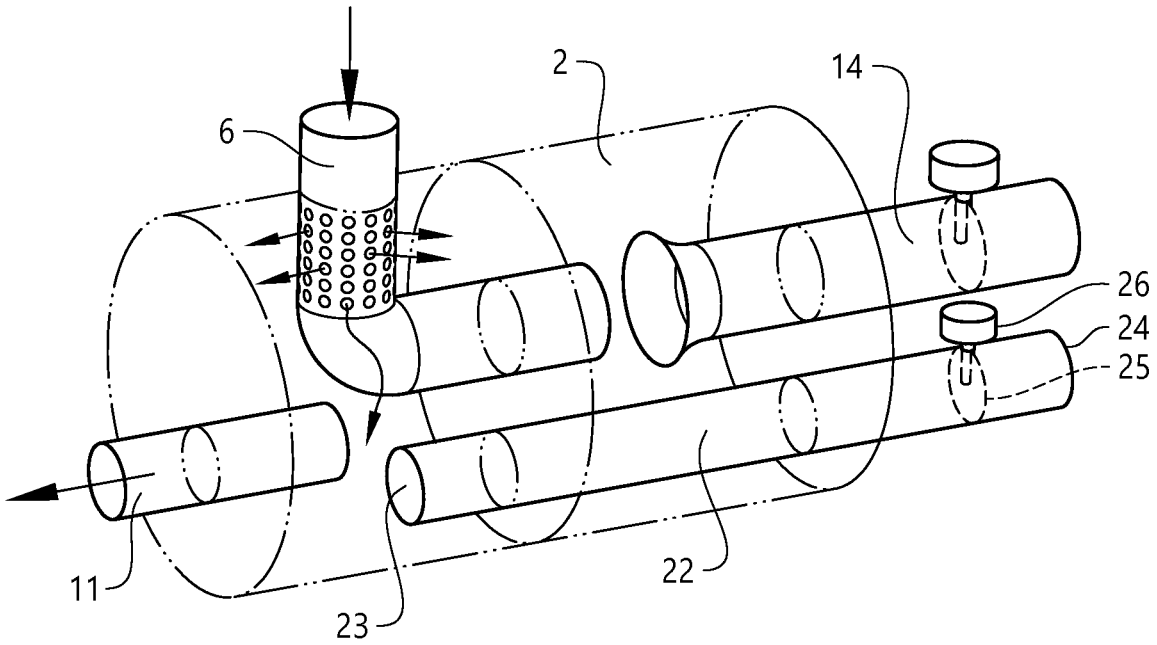
FIG. 3 shows a second example of a muffler according to the invention.
Figure 4:
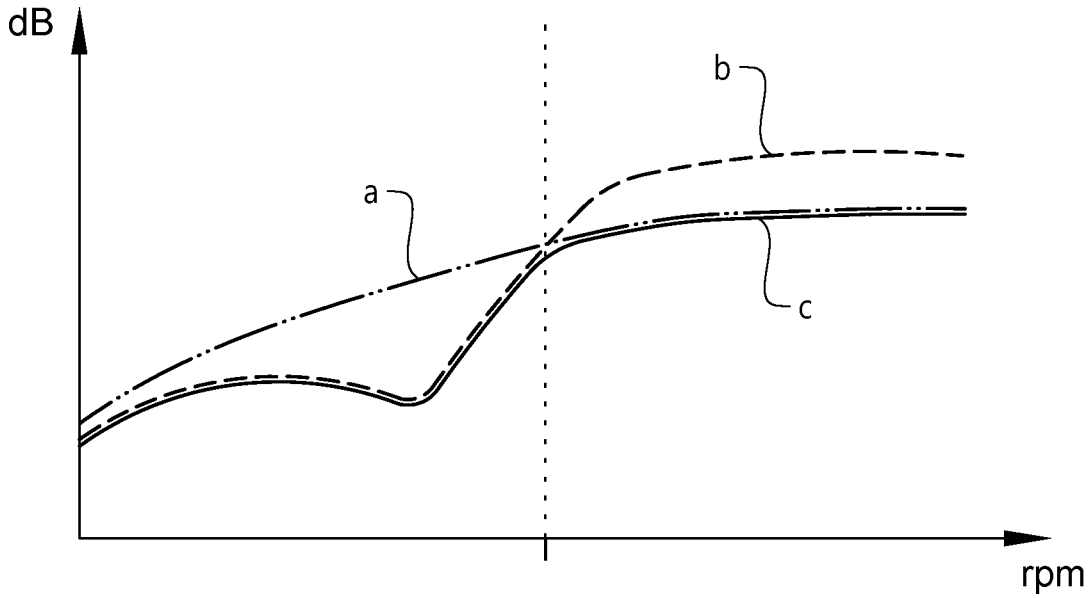
FIG. 4 shows a graph of the relation between attenuation and engine speed for a muffler according to the invention.
Figure 5:
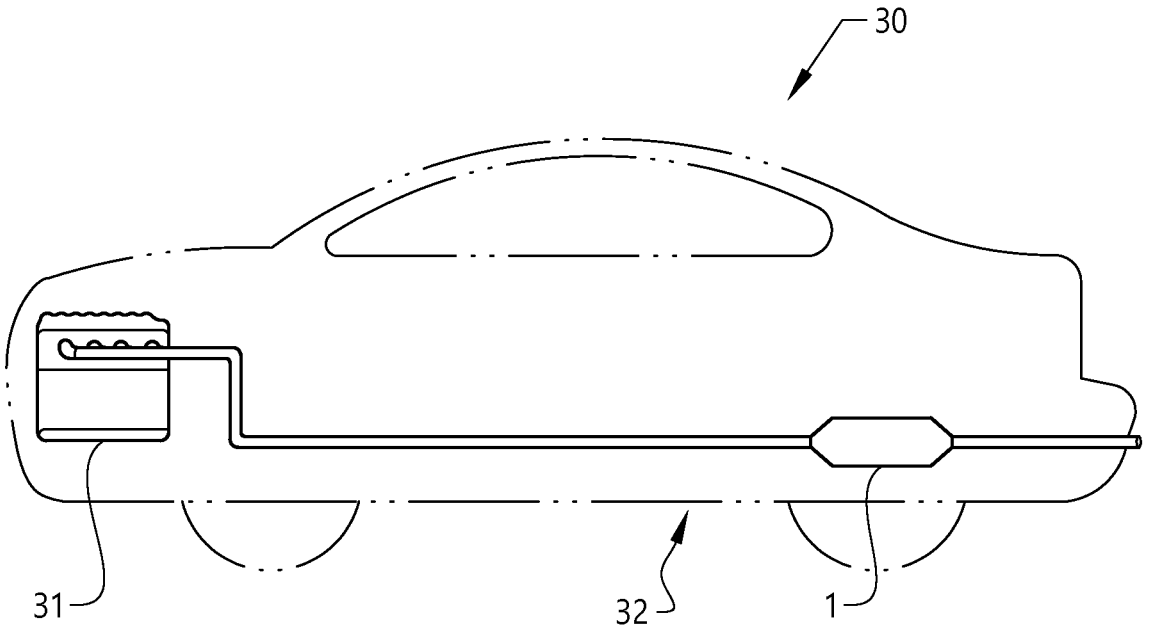
FIG. 5 shows a vehicle comprising a muffler according to the invention.

FIGS. 1 and 2 show a first example of a muffler, FIG. 3 shows a further example of a muffler, FIG. 4 shows a graph of the attenuation for different mufflers and FIG. 5 shows a vehicle comprising a muffler.

The muffler 1 comprises a circumferential outer surface 21, a first end wall 19 and a second end wall 20. The muffler is in the shown example provided with a cylindrical shape, but other shapes are also possible. The first end wall 19, the second end wall 20 and the outer surface 21 constitutes the housing 2 of the muffler. The muffler further comprises an inlet pipe 6, a first outlet pipe 11 and a second outlet pipe 14. The second outlet pipe 14 is provided with a first exhaust valve 17. The inlet pipe is adapted to receive the exhaust gases from the combustion engine and lead them into the muffler, and the first and the second outlet pipes are adapted to exhaust the exhaust gases from the muffler. The muffler 1 further comprises an inner partition wall 3 which divides the interior of the housing 2 in a first chamber 4 and a second chamber 5.

The partition wall may be airtight or may be arranged with one or more smaller openings in the partition wall, in order to introduce a controlled leakage. The purpose of using a controlled leakage is to smooth the damping characteristics of the Helmholtz resonator. With an airtight partition wall, the damping will be relatively sharp at the tuned frequency with a high attenuation at the centre frequency, and with a relatively narrow bandwidth. This corresponds to a relatively high Q factor. With a controlled leakage, the damping characteristics will not be as high at the centre frequency, but with a wider bandwidth. Such a muffler will have a lower Q factor.

The inlet pipe 6 comprises an inlet opening 9 and an outlet opening 10. The inlet opening is adapted to be connected to an exhaust pipe leading from the combustion engine and possibly from a catalyst. In the shown example, the inlet side of the inlet pipe 6 is arranged in the first end wall 19 and the outlet side is arranged in the partition wall 3 with the outlet opening 10 in the second chamber 5. The inlet pipe comprises a perforated section 7 which is provided with a plurality of holes, through which exhaust gases can pass when the first exhaust valve 17 is closed. The open area of the perforated section should for this reason be at least the same size as the area of the inlet pipe, and is preferably larger. The inlet pipe further comprises a further section which will be referred to as a closed section 8 arranged at the partition wall, with the inlet pipe extending through the partition wall 3. The closed section 8 is non-perforated, i.e. the circumferential wall of the closed section 8 is airtight. Thus, the closed section 8 may be referred to as a closed wall section 8. The closed section 8 will constitute the Helmholtz neck of the Helmholtz resonator when the first exhaust valve 17 is closed. When the first exhaust valve 17 is closed, exhaust gas will not be able to pass through the second outlet pipe 14 via the closed section 8 and the second chamber 5, but soundwaves will interact with the closed section 8 and the second chamber, thereby creating the Helmholtz effect. Thus, the inlet pipe 6 may be referred to as a hollow pipe, which allows exhaust gas to flow from the inlet opening 9 to the outlet opening 10, but when the first exhaust valve 17 is closed, no, or a very small initial amount, of exhaust gas is allowed to flow through the outlet opening 10, as the first exhaust valve 17 prevents any gas flow through the second outlet pipe 14.

The first outlet pipe 11 comprises an inlet opening 12 and an outlet opening 13. The inlet opening is arranged in the first chamber 4 and is adapted to exhaust all of the exhaust gases from the inlet pipe 6 when the first exhaust valve 17 is closed, and to exhaust some of the exhaust gases when the first exhaust valve 17 is open. The diameter of the inlet pipe and the first outlet pipe are in the shown example thus substantially the same, but the first outlet pipe 11 may also have a larger diameter. The first outlet pipe 11 extends in the shown example through the second chamber 5 and through the second end wall 20, with the outlet opening 13 arranged outside of the housing 2. At lower engine speeds, when the first exhaust valve 17 is closed, all exhaust gas will exit through be the first outlet pipe 11. The exhaust gas will enter the muffler through the inlet pipe 6, pass through the perforated section 7 and will exit through the first outlet pipe 11. Due to the Helmholtz resonator created by the closed section 8 of the inlet pipe 6 and the second chamber 5, low frequency noise is attenuated.

The second outlet pipe 14 comprises an inlet opening 15 and an outlet opening 16. The inlet opening is arranged in the second chamber 5 and is adapted to exhaust most of the exhaust gases from the inlet pipe 6 when the first exhaust valve 17 is open, in parallel with the first outlet pipe 6. The diameter of the inlet pipe and the second outlet pipe are in the shown example substantially the same, but the second outlet pipe may also have a different diameter that may be larger. The inlet opening 15 may be arranged relatively close to and may be aligned with the outlet opening 10 of the inlet pipe 6. The outlet opening 16 is arranged outside of the housing 2. The second outlet pipe 14 is provided with a first exhaust valve 17 which preferably is arranged outside of the housing 2. The first exhaust valve 17 is controlled by a first actuator 18, which may be an electrically controlled motor, a solenoid or another type of actuator. At lower engine speeds, the first exhaust valve 17 is closed in order to create a Helmholtz resonator. At higher engine speeds, the first exhaust valve is opened such that the muffler will function as a conventional muffler with most of the exhaust gas passing through inlet pipe 6 and the second outlet pipe 14. This is shown in FIG. 2.

The first exhaust valve is opened at a predefined engine speed. In one example, the first exhaust valve is opened at an engine speed of 2600 rpm. The engine speed at which the first exhaust valve 17 is opened will depend on the design of the muffler and the engine, but is preferably in an engine speed region between 2000-3000 rpm. The Helmholtz resonator is in this example tuned to suppress a centre frequency of 75 Hz, and may e.g. be tuned to in a frequency region between 70-85 Hz. The centre frequency for the Helmholtz resonator depends e.g. on the number of cylinders of the combustion engine and is of course also dependent on the emitted low frequency caused by engine pulsations of a specific combustion engine. A four cylinder engine may e.g. have a Helmholtz resonator tuned in the frequency interval between 50-100 Hz.

FIG. 4 shows an example of the attenuation for a conventional muffler with a dash-dotted line a, for a muffler with a Helmholtz resonator with a broken line b, and for a combined muffler according to the invention with a continuous line c.

FIG. 3 shows a further example of a muffler according to the invention, comprising a further outlet pipe. In this example, the inlet pipe 6 is arranged through the circumferential outer surface 21 and the closed section 8 is bent. The first outlet pipe 11 is arranged through the first end wall 19. The second outlet pipe 14 is arranged as described above. The third outlet pipe 22 comprises an inlet opening 23 and an outlet opening 24. The inlet opening 23 is arranged in the first chamber 4 and the outlet opening 24 is arranged outside of the housing 2. In the shown example, the third outlet pipe is arranged through the second chamber 5. However, it should be noted that the outlet openings of the outlet pipes may be arranged in other ways, depending on the design of the muffler and the vehicle. For a vehicle having two visible exhaust ports and a muffler arranged sideways of the vehicle, it may be desirable to have an outlet pipe at each end wall of the muffler in order to simplify the exhaust piping of the vehicle. The diameter of the inlet pipe and the third outlet pipe are in the shown example substantially the same, but the third outlet pipe may have a diameter with a different cross section, depending on the design of the muffler. The third outlet pipe is provided with a second exhaust valve 25, which is controlled by a second actuator 26. The second exhaust valve is set to open at a specified engine speed, and may be opened before the first exhaust valve opens in order to reduce the back pressure of the muffler at lower engine speeds.

FIG. 5 shows a vehicle 30 comprising an internal combustion engine 31 and an exhaust gas system 32 comprising a muffler 1 according to the invention. The internal combustion engine is a spark-ignited gasoline engine which may be charged with a turbo or a supercharger. The volume of the muffler is adapted to the type of vehicle used, and is e.g. dependent on the volume and the engine speed of the used internal combustion engine. A suitable volume for a passenger car may e.g. be 20-50 litres, whereas a two wheel motorbike may have a volume of e.g. 5 litres.

The invention is not to be regarded as being limited to the embodiments described above, a number of additional variants and modifications being possible within the scope of the subsequent patent claims.

The invention claimed is:

1. A muffler for an exhaust gas system of a vehicle comprising an internal combustion engine, the muffler comprising: a gas-tight housing; a partition wall dividing the interior of the housing in a first chamber and a second chamber; an inlet pipe extending through the first chamber and comprising a perforated section arranged in the first chamber and a closed section arranged in the first chamber, wherein an inlet opening of the inlet pipe is arranged outside of the housing and wherein an outlet opening of the inlet pipe is arranged in the second chamber, the outlet opening being permanently open towards the second chamber; a first outlet pipe comprising an inlet opening arranged in the first chamber and an outlet opening arranged outside of the housing; and a second outlet pipe having an inlet opening arranged in the second chamber and an outlet opening arranged outside of the housing, wherein the second outlet pipe is provided with a first exhaust valve adapted to open or close the exhaust gas flow through the second outlet pipe.

2. The muffler according to claim 1, wherein the first outlet pipe extends through the second chamber.

3. The muffler according to claim 1, wherein the muffler comprises a third outlet pipe having an inlet opening arranged in the first chamber and an outlet opening arranged outside of the housing, and where the third outlet pipe is provided with a second exhaust valve adapted to open or close the exhaust gas flow through the third outlet pipe.

4. The muffler according to claim 3, wherein the second exhaust valve is adapted to open before the first exhaust valve.

5. The muffler according to claim 1, wherein the first exhaust valve is electrically controlled.

6. The muffler according to claim 1, wherein the first exhaust valve is adapted to be opened at an engine speed of between 2000-3000 rpm.

7. The muffler according to claim 1, wherein the closed section of the inlet pipe and the second chamber constitutes a Helmholtz resonator having a centre frequency between 50-100 Hz.

8. The muffler according to claim 1, wherein the closed section of the inlet pipe and the second chamber constitutes a Helmholtz resonator having a centre frequency between 70-85 Hz.

9. The muffler according to claim 1, wherein the closed section of the inlet pipe and the second chamber constitutes a Helmholtz resonator having a centre frequency of 75 Hz.

10. The muffler according to claim 1, wherein the partition wall is airtight.

11. The muffler according to claim 1, wherein the partition wall is provided with at least one opening that is arranged to provide a controlled leakage between the first chamber and the second chamber.

12. A vehicle comprising an exhaust gas system and an internal combustion engine, the exhaust gas system comprising a muffler comprising: a gas-tight housing; a partition wall dividing the interior of the housing in a first chamber and a second chamber; an inlet pipe extending through the first chamber and comprising a perforated section arranged in the first chamber and a closed section arranged in the first chamber, wherein an inlet opening of the inlet pipe is arranged outside of the housing and wherein an outlet opening of the inlet pipe is arranged in the second chamber, the outlet opening being permanently open towards the second chamber; a first outlet pipe comprising an inlet opening arranged in the first chamber and an outlet opening arranged outside of the housing; and a second outlet pipe having an inlet opening arranged in the second chamber and an outlet opening arranged outside of the housing, wherein the second outlet pipe is provided with a first exhaust valve adapted to open or close the exhaust gas flow through the second outlet pipe.

13. The vehicle according to claim 12, wherein the first outlet pipe extends through the second chamber.

14. The vehicle according to claim 12, wherein the muffler comprises a third outlet pipe having an inlet opening arranged in the first chamber and an outlet opening arranged outside of the housing, and where the third outlet pipe is provided with a second exhaust valve adapted to open or close the exhaust gas flow through the third outlet pipe.

15. The vehicle according to claim 14, wherein the second exhaust valve is adapted to open before the first exhaust valve.

16. The vehicle according to claim 12, wherein the first exhaust valve is electrically controlled.

17. The vehicle according to claim 12, wherein the first exhaust valve is adapted to be opened at an engine speed of between 2000-3000 rpm.

18. The vehicle according to claim 12, wherein the closed section of the inlet pipe and the second chamber constitutes a Helmholtz resonator having a centre frequency between 50-100 Hz.

19. The vehicle according to claim 12, wherein the partition wall is airtight.

20. The vehicle according to claim 12, wherein the partition wall is provided with at least one opening that is arranged to provide a controlled leakage between the first chamber and the second chamber.

* * * * *